US006334790B2

(12) United States Patent
Kashiyama et al.

(10) Patent No.: US 6,334,790 B2
(45) Date of Patent: Jan. 1, 2002

(54) ELECTRICAL CONNECTION AND HOUSING HAVING A LANCE IN A TERMINAL ACCOMMODATION CHAMBER

(75) Inventors: Motohisa Kashiyama; Haruki Yoshida, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/805,363

(22) Filed: Mar. 14, 2001

(30) Foreign Application Priority Data

Mar. 14, 2000 (JP) ..... 12-071250

(51) Int. Cl.[7] ..... H01R 13/40
(52) U.S. Cl. ..... 439/595; 439/752
(58) Field of Search ..... 439/595, 744, 439/752

(56) References Cited

U.S. PATENT DOCUMENTS 4,174,144 A * 11/1979 Le Helloco ..... 439/595

FOREIGN PATENT DOCUMENTS

| | | |
|---|---|---|
| JP | 58-60875 | 4/1983 |
| JP | 6-33373 | 4/1994 |

* cited by examiner

*Primary Examiner*—Tho D. Ta
(74) *Attorney, Agent, or Firm*—Sughrue Mion, PLLC

(57) ABSTRACT

An electrical connector and housing includes a terminal (3) and a connector housing (2) having a terminal accommodation chamber (4). The terminal (3) has elastic curled portions (25) that are substantially crest shaped in cross section. A lance (5) for engaging the terminal (3) is formed in the terminal accommodation chamber (4), and tapered portions (22) along which the elastic curled portions (25) slide are formed on the lance (5).

8 Claims, 7 Drawing Sheets

ELECTRICAL CONNECTION AND HOUSING HAVING A LANCE IN A TERMINAL ACCOMMODATION CHAMBER

BACKGROUND OF THE INVENTION

1. Technical Field

The present invention relates to a connector, and relates in particular to a connector having an improved lance in a terminal accommodation chamber.

2. Related Art

A connector used, for the connection of a wire harness for an automobile, comprises: a conductive female terminal having a well-known structure; and a connector housing made of a synthetic resin that accommodates the terminal.

The terminal is formed of a conductive thin metal sheet. A pair of elastic curled portions, which are substantially crest shaped in cross section and which are used for making electrical contact, are formed on two opposing sides of a base plate. Each of the elastic curled portions has an inner slope and an outer slope (refer to a terminal (low insertion force terminal) previously proposed by the present applicant in JP-A-6-33373U).

The connector housing includes a terminal accommodation chamber for the terminal. The terminal accommodation chamber penetrates the connector housing from front side to rear side thereof. A terminal insertion port is formed at the rear of the connector housing, and a connection port for the other male terminal is formed at the front.

In the terminal accommodation chamber, a lance is formed for holding the accommodated terminal, and a permissible space is defined for elastic displacement relative to the lance. The lance has a rectangular cross-section and is shaped like an arm. A tongue shape distal end portion is formed at its tip. An engagement protrusion portion is formed at the vicinity of the distal end of the lance and projects toward the terminal. This protrusion portion is engaged with the elastic curled portions of the terminal and restricts movement in the removal direction. The permissible space for elastic displacement is a space that permits the elastic movement of the lance when the terminal is inserted.

For the related connector, the elastic curled portions of the terminal of the connector are substantially crest shaped. Therefore, when the terminal is inserted during the assembly process, the inner slopes of the elastic curled portions may scrape off the corners of the lance. Further, since the elastic curled portions abut upon the corners of the lance, it is apparently not possible for the terminal to be inserted smoothly (it feels as though the terminal impinges against the lance)

SUMMARY OF THE INVENTION

To solve the above problem, it is one objective of the present invention to provide a connector that permits a terminal to be smoothly inserted, while at the same time preventing damage to a lance, and wherein the displacement value for the lance is ensured when the terminal is inserted.

To achieve the above objective, according to the invention, a connector comprising:

- a connector housing;
- a terminal formed of a conductive thin metal plate including,
  - a base, and
  - a pair of elastic curled portions having a crest shape in cross section which are connected to opposite ends of the base portion and bent inward;

- a terminal accommodation chamber for accommodating the terminal provided with a connector housing; and
- a lance in the terminal accommodation chamber including,
  - a body portion extended in an insertion direction in which the terminal is inserted,
  - an engagement protrusion formed at the body portion for engaging with the terminal to restrict the terminal to move in a direction opposed to the insertion direction when the terminal is completely accommodated in the terminal accommodation chamber, and
  - a pair of taped portions along which the pair of elastic curled portion slides during the terminal moving along the terminal accommodation chamber.

According to the invention, the pair of tapered portions are tapered from a base portion to a distal end of the body portion.

According to the invention, the inclination of the pair of tapered portions substantially matches the inclination of the inner slopes of the pair of elastic curled portions.

According to the invention, when the terminal is inserted into the terminal accommodation chamber, the elastic curled portions of the terminal act on the lance. Then, the elastic curled portions elastically bend the lance while sliding along the tapered portions, and since the tapered portions are formed at that location on the lance against which the elastic curled portions of the terminal abut when inserted in the accommodation chamber, scraping of the lance by the elastic curled portions does not occur. Further, since the elastic curled portions abut against the tapered portions along which they slide, there is no feeling that the terminal has been rammed into the corners. In addition, since the elastic curled portions slide along and are guided by the tapered portions, when the terminal is inserted the same displacement value is ensured for the lance as in the related art.

According to the invention, the tapered portions along which the elastic curled portions slide are tapered from the base end of the lance to the distal end. Therefore, even in the presence of these tapered portions, an appropriate size can be obtained for the portions that engage the terminal, and the terminal can be securely held by the lance.

According to the invention, since the inclination of the tapered portions along which the elastic curled portions slide substantially matches the inclination of the inner slopes of the elastic curled portions, the elastic curled portions can more smoothly slide along the tapered portions.

DESCRIPTION OF PREFERRED EMBODIMENTS

First embodiment of the invention will now be described while referring to the accompanying drawings.

Figure 1:
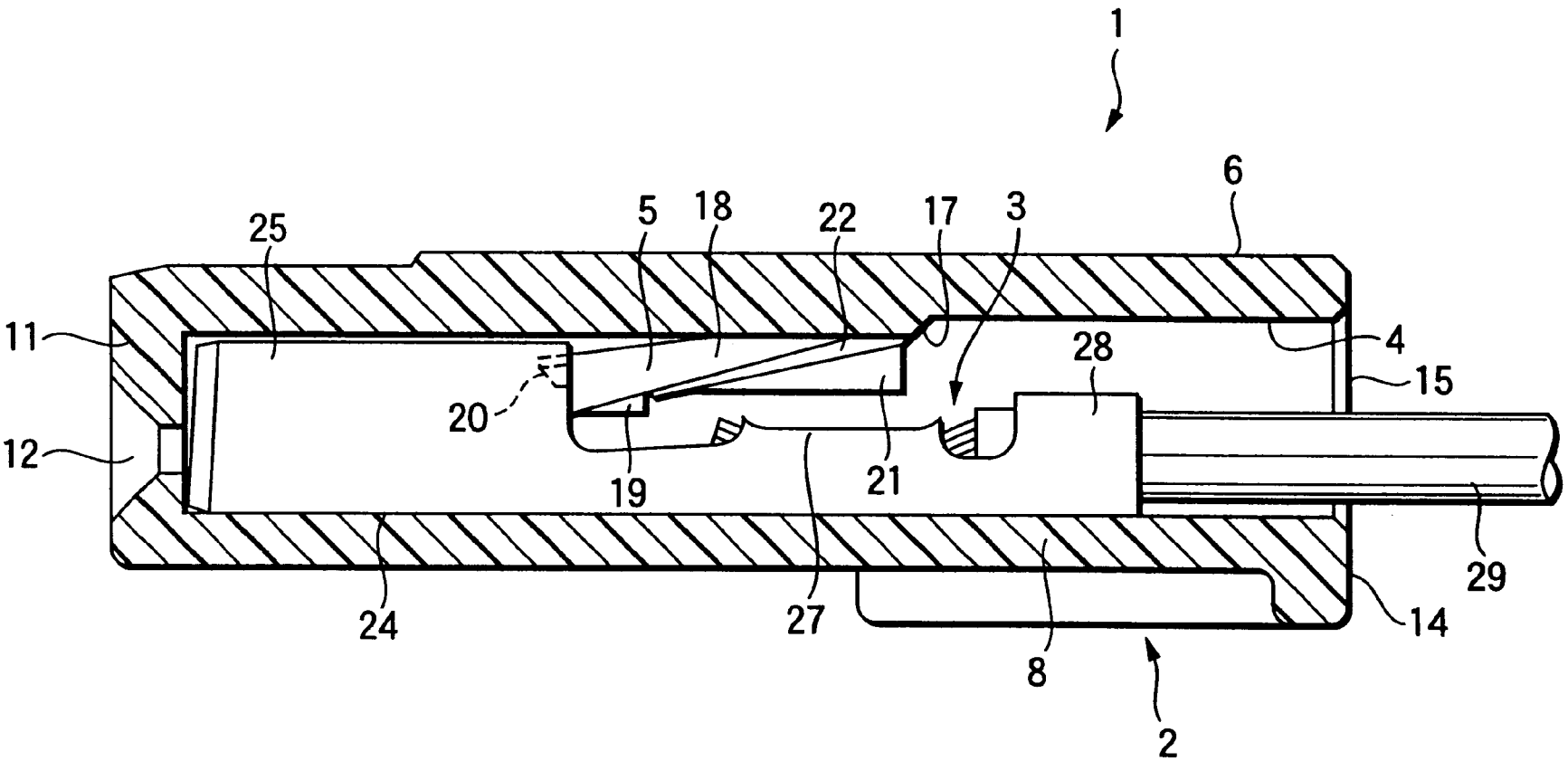
FIG. 1 is a cross-sectional view of a connector according to one embodiment of the invention.
Figure 2:
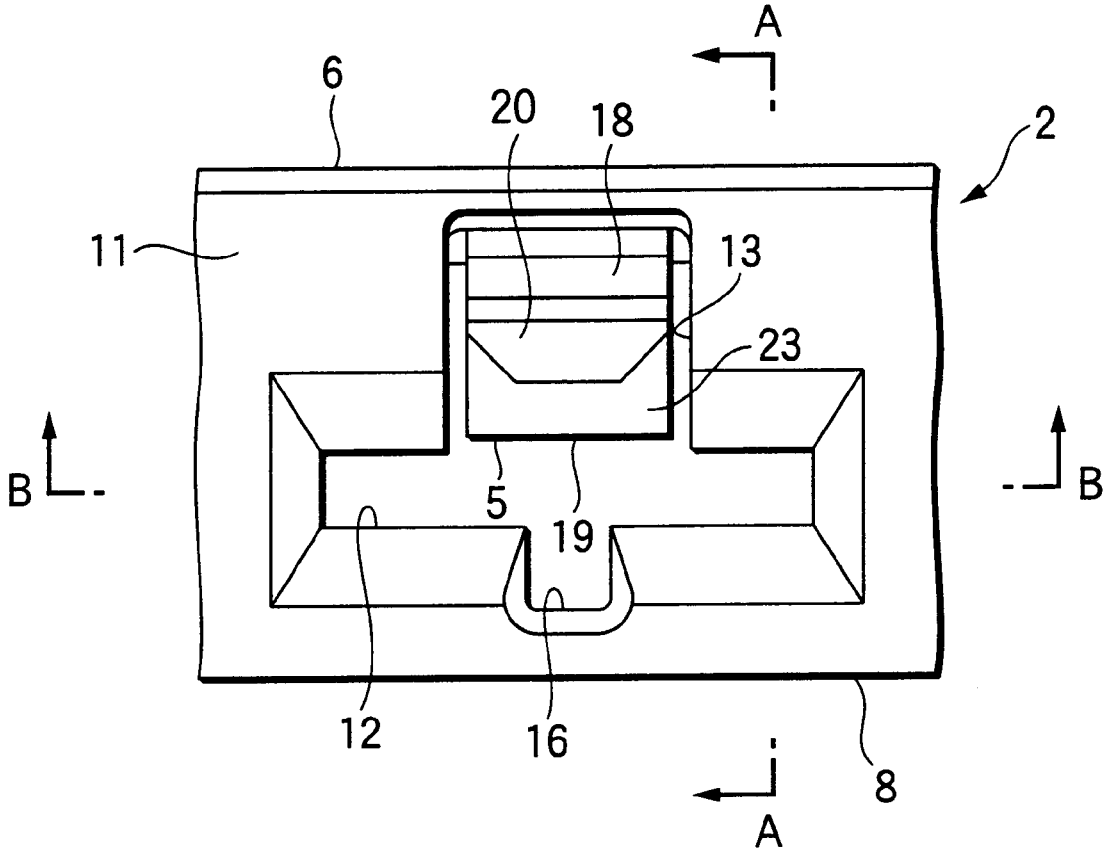
FIG. 2 is a front view of a connector housing.
Figure 3:
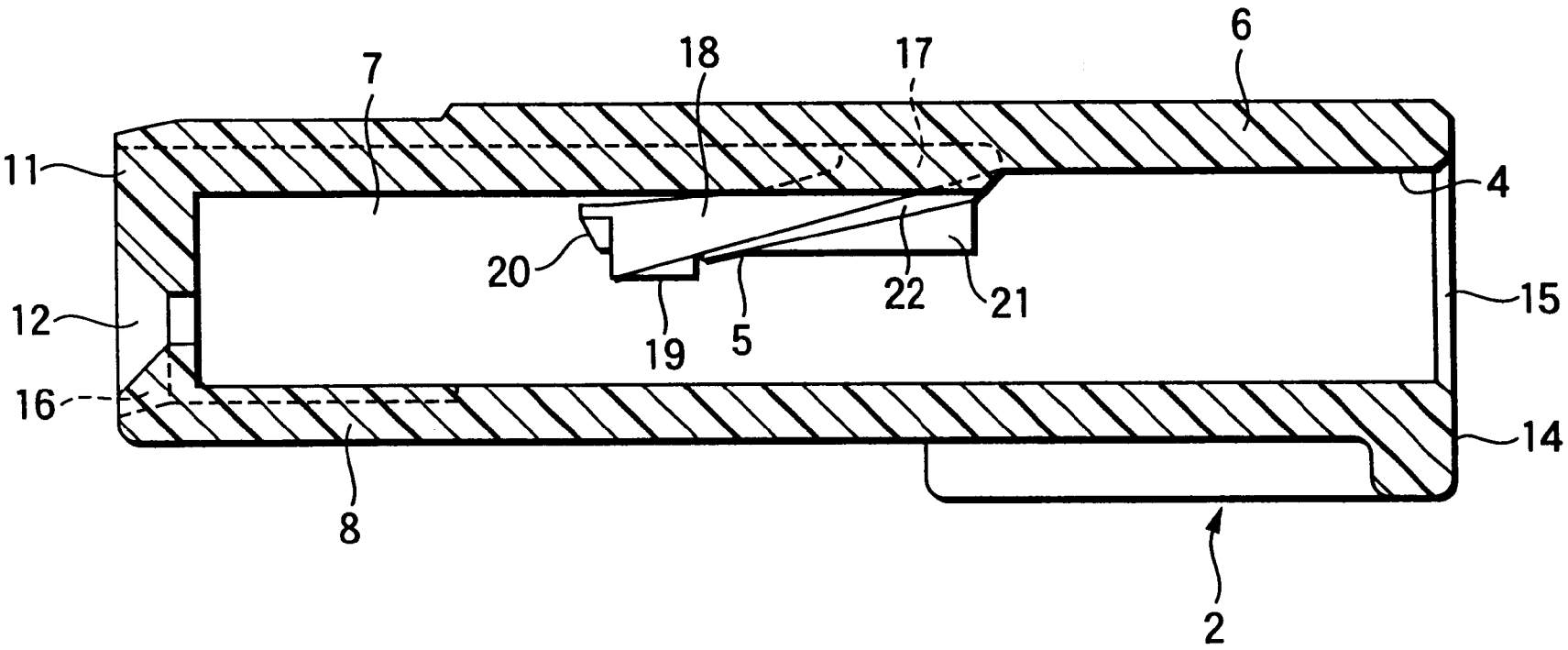
FIG. 3 is a cross-sectional view taken along line A—A in FIG. 2.
Figure 4:
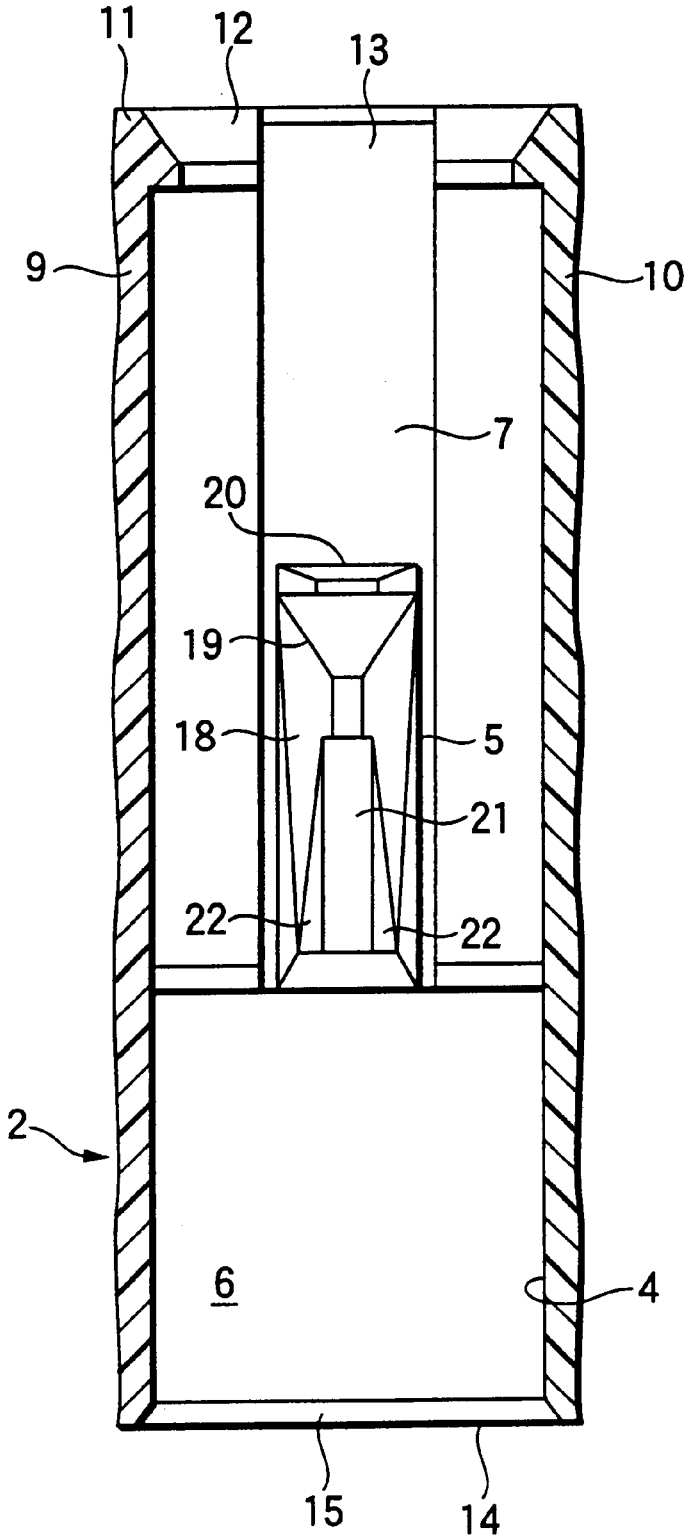
FIG. 4 is a cross-sectional view taken along line B—B in FIG. 2.
Figure 5:
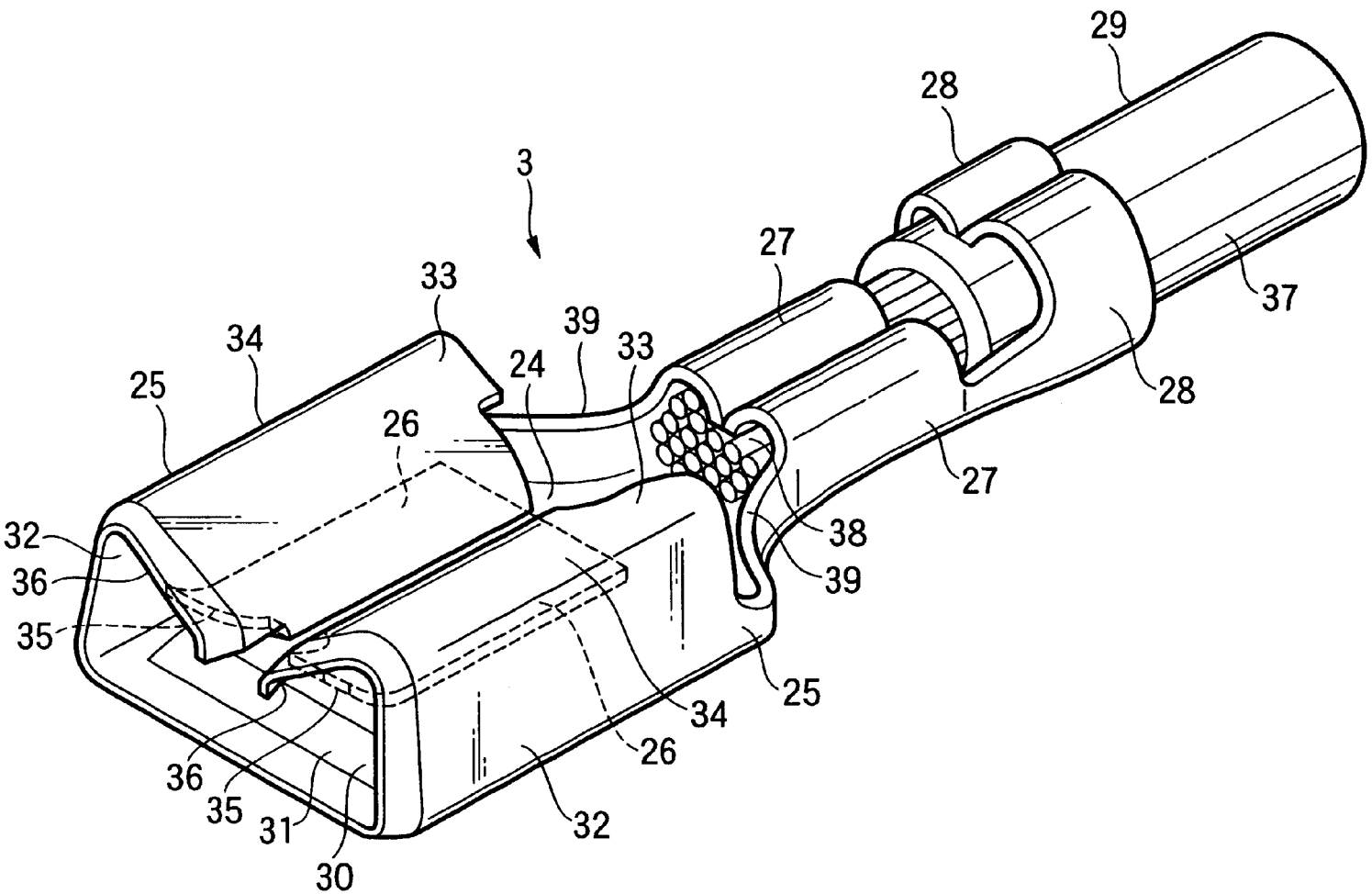
FIG. 5 is a perspective view of the external appearance of a terminal.
Figure 6:
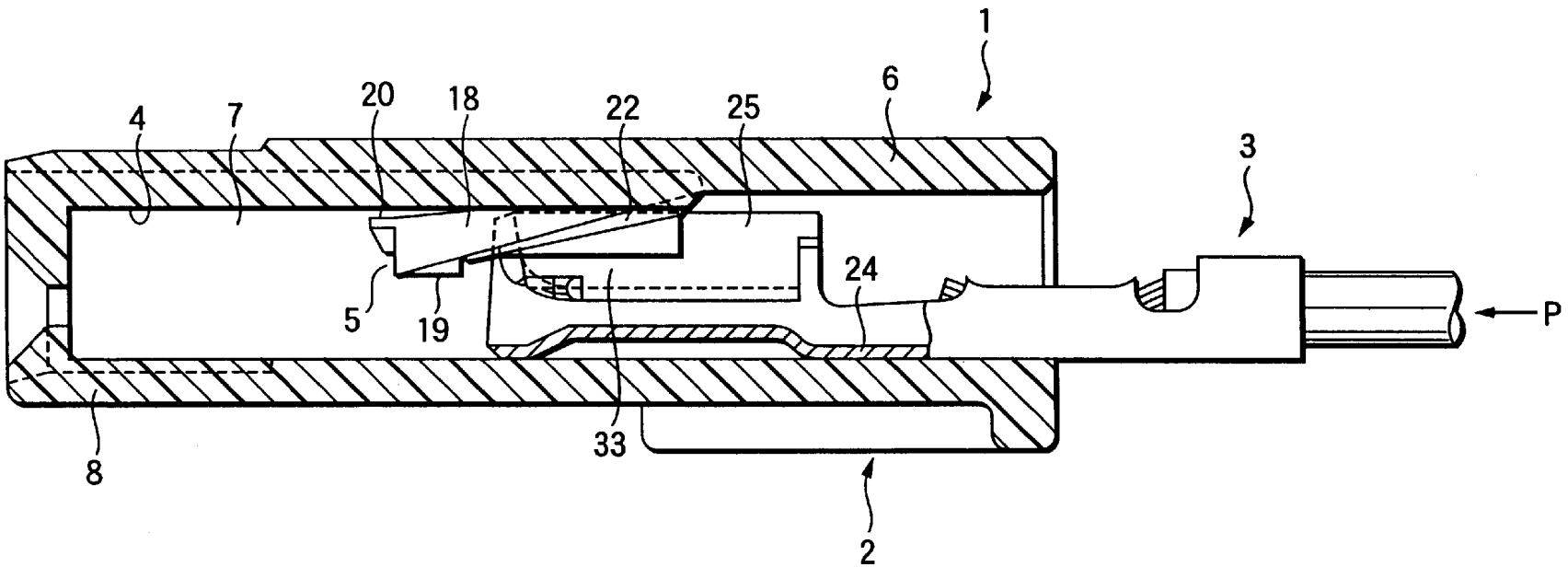
FIG. 6 is a cross-sectional view of the connector when the terminal is inserted.
Figure 7:
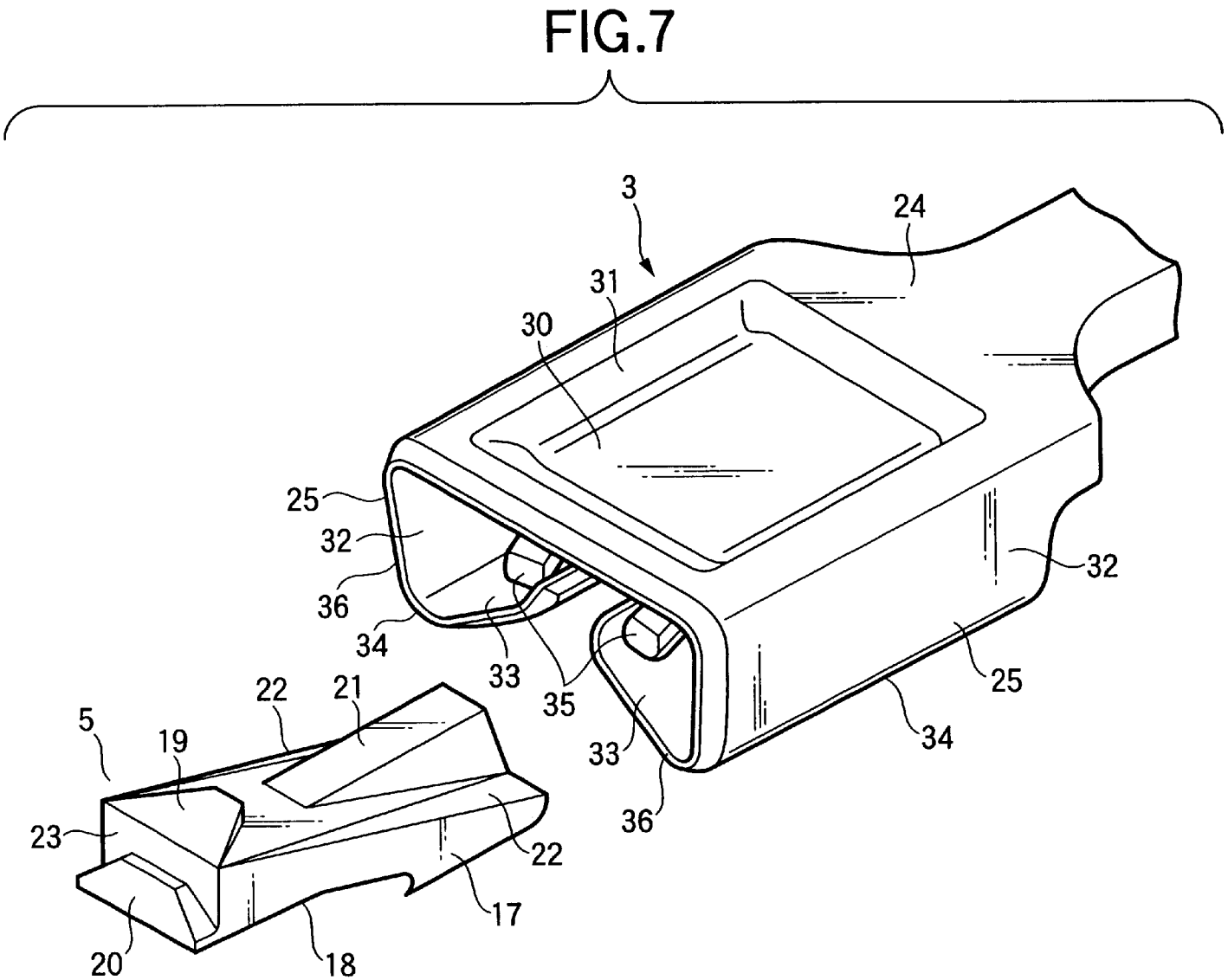
FIG. 7 is a perspective view of the terminal and a lance when the terminal is inserted.

FIG. 1 is a cross-sectional view of a connector according to the embodiment of the invention. FIG. 2 is a front view of the connector. FIG. 3 is a cross-sectional view taken along a line A—A in FIG. 2. FIG. 4 is a cross-sectional view taken along a line B—B in FIG. 2. FIG. 5 is a perspective view of the outer appearance of a terminal. FIG. 6 is a cross-sectional view of the connector when the terminal is inserted. FIG. 7 is a perspective view of the terminal and a lance when the terminal is inserted.

In FIG. 1, a connector 1 used for the connection of a wire harness for an automobile comprises a connector housing 2 made of a synthetic resin and a plurality (only one shown) of terminals 3 accommodated inside the connector housing 2. The connector 1 is characterized by an improved lance 5 that is formed in the terminal accommodation chamber 4 in the connector housing wherein the terminal 3 is accommodated.

The individual components will now be described.

The connector housing 2 is shaped like a rectangular box, and as is shown in FIGS. 2 to 4. The connector housing 2 forms a plurality of terminal accommodation chambers 4 penetrating the connector housing from the front to the rear thereof (although in the example only one is shown, the count corresponds to the number of the terminal 3).

The terminal accommodation chamber 4 defines a rectangular space wherein the terminal 3 (see FIG. 1) can be accommodated. The lance 5 for engaging the completely inserted terminal 3 (see FIG. 1) is integrally formed with an upper wall 6 of the terminal accommodation chamber 4. A permissible space 7 for the elastic displacement of the lance 5 is defined between the lance 5 and the upper wall 6. The permissible space 7 for elastic displacement is provided in order for the lance 5 to be elastically bent.

A lower wall 8 of the terminal accommodation chamber terminal 4 opposite the upper wall 6 is flat. A base 24 (see FIG. 5) of the terminal 3, which will be described later, slides along the lower wall 8. A left wall 9 and a right wall 10, which are perpendicular to the upper wall 6 and the lower wall 8, are used as partition walls for adjacent terminal accommodation chambers 4 (not shown). In this embodiment, the upper wall 6 and the lower wall 8 are defined by the upper wall and the lower wall of the connector housing 2. It should be noted that the upper wall 6 and the lower wall 8 might serve as partition walls for terminal accommodation chambers 4 that are vertically arranged.

The terminal accommodation chamber 4 communicates with a connection port 12 and a detection pin insertion port 13, which are formed in a front wall 11 of the connector housing 2, and a terminal insertion port 15, which is formed at the rear end 14 of the connector housing 2.

In the front view, the connection port 12 is shaped like a long hole, and another female terminal (not shown) can be received therein. The connection port 12 communicates with a contact pin insertion port 16 that is used for inserting the conductive contact pin (not shown) of a conductive connector testing tool (not shown).

The contact pin insertion port 16, which is substantially a U-shaped notch, is on the side opposite the detection insertion port 13. The connection port 12 is positioned between the two insertion ports. The conducive contact pin (not shown) is inserted into (or removed from) the terminal accommodation chamber 4 through the contact insertion port 16.

The detection pin insertion port 13 is positioned nearer to the upper wall 6 than the connection port 12. The lance displacement detection pin (not shown) of a conductive connector testing tool (not shown) is inserted into (or removed from) the terminal accommodation chamber 4 through the detection pin insertion port 13. The detection pin insertion port 13 communicates with the connection port 12 in the center portion of the connection port 12.

It should be noted that the vertical direction corresponds to the up and down directions in FIG. 2, the forward and rearward directions correspond to the left and right directions in FIG. 1, and the direction to the right and left correspond to the direction to the right and left in FIG. 2.

As shown in FIGS. 3 and 4, the lance 5 is an arm-shaped engagement member positioned substantially in the center of the upper wall 6 and extending forward and backward along the insertion direction P (see FIG. 6) of the terminal 3. When the terminal 3 (see FIG. 1) is fully inserted into the terminal accommodation chamber 4, the lance 5 restricts the movement of the terminal 3 (see FIG. 1) in the removal direction (not shown), the opposite of the insertion direction P (see FIG. 6).

The lance 5 comprises a base portion 17, a middle portion 18, an engagement protrusion 19, and a distal end 20. The lance 5 is designed so that the distal end 20 is bent upward (elastically bent) toward the upper wall 6, and the engagement protrusion 19 is engages the terminal 3 (see FIG. 1).

The base portion 17 is positioned substantially in the center of the upper wall 6 in the forward and backward direction. One end part of the middle portion 18 is integrally formed with the base portion 17 at the distal end of the base portion in the projecting direction, and has a width same as the base portion 17. The middle portion 18 is formed like a flat rod or a flat plate. The other end part of the middle portion 18 extends obliquely downward from the base portion 17. A rib 21, having a right-angle triangular shape (viewed from the right and left), is integrally formed in the center of the face of the middle portion 18 of the lower wall 8 side. A pair of tapered portions 22 are formed on opposite sides of the rib 21.

The hypotenuse of the right-angle triangular of the rib 21 is continued to the face of the middle portion 18 of the lower wall 8 side. The remaining sides of the triangle correspond to the vertical and the forward and backward directions.

The pair of tapered portions 22 are formed at areas on the middle portion 18 that originally served as edges, and are positioned so that they abut upon elastic curled portions 25 (see FIG. 5) (which will be described later) of the terminal 3 (see FIG. 1) that is inserted into the terminal accommodation chamber 4. The tapered portions 22, which gradually narrow, extend from one end to the other of the middle portion 18, so that an appropriate size is ensured for the engagement protrusion 19. In viewed from the insertion direction P of the terminal 3 (see FIG. 1) i.e. from the forward and backward direction, the tapered portions 22 are tapered from the upper wall 6 toward the lower wall 8. This inclination of the tapered portions 22 substantially matches the inclination of inner slopes 33 (see FIG. 5) of the elastic curled portions 25 (see 3,3 FIG. 5) (this is merely a description of the preferred embodiment, and the invention is not hereby limited). The pair of tapered portions 22 are provided for smoothly sliding along the elastic curled portions 25 (see FIG. 5).

The engagement protrusion 19 and the distal end 20 are continuously formed at and near the distal end of the middle portion 18. The other end of the middle portion 18 has an engagement face 23 parallel to the vertical direction that engages the terminal 3 (see FIG. 1).

The engagement protrusion 19 is formed on the other end of the middle portion 18 at the face of the lower wall 8 side.

The engagement protrusion 19 has a right-angle triangular shape in view of the right and left direction (the directivity of each side is the same as the rib 21), and is shaped like a trapezoid in view of the lower wall 8 (the upper side is near the center of the middle portion 18, and the lower side corresponds to the width of the middle portion 18).

The distal end 20 projects outward from the upper wall 6 side of the distal end of the middle portion 18. The distal end 20 is shaped like a trapezoid in view of forward direction, i.e. the width of the distal end 20 become narrower toward the lower wall 8. The individual slopes of the trapezoid (the slopes of the distal end 20) substantially match the inclinations of the inner slopes 33 (see FIG. 5) of the elastic curled portions 25 (see FIG. 5).

When the lance 5 is bent, the distal end 20 is always positioned in the permissible space 7 provided for elastic displacement.

As shown in FIGS. 5 to 7, the terminal 3 is a female terminal that is manufactured by performing a pressing process for a thin conductive metal plate multiple times. The terminal 3 comprises: the base 24, which is shaped substantially like a spatula; the pair of elastic curled portions 25 and a pair of electric contact pieces 26 which are formed at the front of the base 24; and a pair of conductive pressing portions 27 and a pair of pressed portions 28 that are formed at the rear of the base 24.

The front portion of the terminal 3 is used as an electric contact portion for another male terminal (not shown), and the rear portion is used as an electric wire connection portion for one of electric wires 29 that, for example, constitute the wiring harness for an automobile.

An electric contact convex portion 30 is formed at the front of the base 24, and is extended toward the elastic curled portions 25 by embossing. The electric contact convex portion 30 and the electric contact pieces 26 are to hold the male terminal (not shown). In the electric contact convex portion 30, a taper 31 is provided along the perimeter, and the front portion of the taper 31 guides the male terminal to a predetermined location.

The elastic curled portions 25 are so designed that, on opposite sides at the front of the base 24, wide pieces are continuously formed in the direction in which the base 24 is extended, and are bent inward so that their cross-sections are substantially crest shaped. Outer slopes 32 of the elastic curled portions 25 (because of their substantially crest shape in cross section) are formed as steep slopes that are almost perpendicular to the base 24. The angles of inner slopes 33 are less gradual than that of the outer slopes 32.

Reference numeral 34 denotes the crests of the elastic curled portions 25.

The electric contact pieces 26 are formed like belts in the direction in which the base 24 is extended. The distal ends of the elastic curled portions 25 are bent upward, slightly obliquely, at a small angle. Front ends 35 of the electric contact pieces 26 are bent upward, so that the male terminal (not shown) can be guided to a predetermined position. The front ends 35 of the electric contact pieces 26 are positioned farther inward than front ends 36 of the elastic curled portions 25 are.

Core lines 38 are exposed by removing an insulation portion 37 from the end of the electric wire 29. The conductive pressing portions 27 for pressing the core lines 38 are formed at the opposite sides of the rear of the base 24 closer to the front. When the conductive pressing portions 27 are crimped, the core lines 38 are press-connected.

Low frame portions 39 are continuously formed to opposite sides of the base 24 between the conductive pressing portions 27 and the elastic curled portions 25.

Insulation pressing portions 28 for pressing the cover 37 of the electric wire 29 are continuously formed at the opposite sides of the rear of the base 24 which located in the rear of the conductive pressing portion 27. Each insulation pressing portions 28 has a longer rectangular plate shape than the conductive pressing portions 27. When the insulation pressing portions 28 are crimped, the insulation portion 37 is pressed, and through the insulation 37, the inner core lines 38 are pressed.

With this arrangement, to assemble the connectors 1, r terminals 3 are inserted into corresponding terminal accommodation chambers 4.

In FIG. 6, when the terminal 3 is inserted into the terminal accommodation chamber 4, the lance 5 of the terminal accommodation chamber 4 is elastically bent due to the insertion of the terminal 3. That is, the front ends of the elastic curled portions 25 (only one is shown in FIG. 6; the same thing is applied for the following process) of the terminal 3 abut against and push the tapered portions 22 of the lance 5. In the permissible space 7, the lance 5 is elastically bent in the direction in which the distal end 20 approaches the upper wall 6. Then, the elastic curled portions 25 slide along the tapered portions 22. The lance 5 is elastically bent and slides along the elastic curled portions 25.

In this state, when the terminal 3 is pushed forward and the distal end 20 is passed through the elastic curled portions 25, a recovery force returns the lance 5 to its original position, and the lance 5 is engaged with the rear ends of the elastic curled portions 25 (see FIG. 1).

As a result, the terminal 3 is fully contained in the terminal accommodation chamber 4. Since the terminal 3 is engaged by the lance 5, the removal of the terminal 3 from the terminal accommodation chamber 4 can be prevented.

When all the terminals 3 are held in the corresponding terminal accommodation chambers 4, the assembly of the connectors 1 is completed.

In conclusion, while referring to FIG. 7, the elastic curled portions 25 elastically bend the lance 5 while sliding along the tapered portions 22 of the lance 5. Since the tapered portions 22 along which the elastic curled portions 25 slide are formed at areas on the lance 5 that contact the curled portions 25 when the terminal 3 is inserted into the terminal accommodation chamber 4, scraping of the lance 5 by the elastic curled portions 25 can be prevented. Further, since the elastic curled portions 25 abut upon the tapered portions 22 along which the curled portions 25 slide, there is no sensation that the terminal 3 impinges against the corners of the lance 5. In addition, since the tapered portions 22 are provided for the elastic curled portions 25 to slide along, the conventional displacement value for the lance S when the terminal 3 is inserted can be maintained.

This invention can be variously modified without departing from the scope of the invention.

As is described above, according to the present invention, since the tapered portions along which the elastic curled portions slide are formed for the lance, scraping of the lance by the elastic curled portions can be prevented. Further, there is no sensation that the terminal impinges against the corners of the lance. Since the tapered portions are provided for the elastic curled portions to slide along, the conventional displacement value for the lance can be maintained when the terminal is inserted.

Therefore, according to the connector of the invention, the terminal can be smoothly inserted without damaging the lance, and the displacement value for the lance when the terminal is inserted is ensured.

Further, since the tapered portions used for sliding the elastic curled portions narrow from the base to the distal end of the lance, an appropriate size can be obtained for the portions that engage the end of the lance. Thus, the terminal can be securely held, as in the related art.

Further, the inclination of the tapered portions along which the elastic curled portions slide substantially matches the inclination of the inner slopes of the elastic curled portions. Therefore, the elastic curled portions can slide more smoothly.

What is claimed is:

1. A connector comprising:

a connector housing;

a terminal formed of a conductive thin metal plate including, a base, and a pair of elastic curled portions having a crest shape in cross section which are connected to opposite ends of the base and bent inward;

a terminal accommodation chamber for accommodating the terminal provided within the connector housing; and a lance in the terminal accommodation chamber including, a body portion extended in an insertion direction in which the terminal is inserted, an engagement surface formed at the body portion for engaging with the terminal to restrict the terminal to move in a direction opposed to the insertion direction when the terminal is completely accommodated in the terminal accommodation chamber, and a pair of tapered portions formed at the body portion along which the pair of elastic curled portion slides during the terminal moving along the terminal accommodation chamber.

2. The connector according to claim 1, wherein an inclination of the pair of tapered portions substantially matches an inclination of inner slopes of the pair of elastic curled portions.

3. The connector according to claim 1, wherein the pair of tapered portions are tapered from a base portion of the body portion to a distal end of the body portion.

4. The connector according to claim 3, wherein an inclination of the pair of tapered portions substantially matches an inclination of inner slopes of the pair of elastic curled portions.

5. A connector comprising:

a connector housing;

a terminal formed of a conductive thin metal plate including, a base, and a pair of elastic curled portions having a crest shape in cross section which are connected to opposite ends of the base and bent inward;

a terminal accommodation chamber for accommodating the terminal provided within the connector housing; and a lance in the terminal accommodation chamber including, a body portion extended in an insertion direction in which the terminal is inserted, an engagement surface formed at the body portion for engaging with the terminal to restrict the terminal to move in a direction opposed to the insertion direction when the terminal is completely accommodated in the terminal accommodation chamber, and a pair of tapered portions formed at the body portion along which the pair of elastic curled portion slides during the terminal moving along the terminal accommodation chamber, wherein said lance is operable to deform elastically to accommodate entry of said terminal into said connector housing and operable to elastically recover to its original position upon complete entry of said terminal into said connector housing.

6. The connector according to claim 5, wherein an inclination of the pair of tapered portions substantially matches an inclination of inner slopes of the pair of elastic curled portions.

7. The connector according to claim 5, wherein the pair of tapered portions are tapered from a base portion of the body portion to a distal end of the body portion.

8. The connector according to claim 7, wherein an inclination of the pair of tapered portions substantially matches an inclination of inner slopes of the pair of elastic curled portions.

* * * * *